United States Patent [19]

Kohn

[11] 4,386,448

[45] Jun. 7, 1983

[54] EATING AND ORAL HYGIENE AID

[76] Inventor: Irving Kohn, P.O. Box 1112, Vallejo, Calif. 94590

[21] Appl. No.: 249,049

[22] Filed: Mar. 30, 1981

Related U.S. Application Data

[63] Continuation-in-part of Ser. No. 102,272, Dec. 10, 1979, abandoned.

[51] Int. Cl.[3] ..... A47J 45/00; B25G 1/00

[52] U.S. Cl. ..... 16/121; 401/6

[58] Field of Search ..... 401/6, 48, 88, 50–52; 16/114 R, 118, 121, DIG. 19; 15/437, 443, 444; 145/3.31, 3.5

[56] References Cited

U.S. PATENT DOCUMENTS

| | | | |
|---|---|---|---|
| 940,744 | 11/1909 | Smith | 401/6 X |
| 1,438,114 | 12/1922 | Hume | 401/6 |
| 1,568,883 | 1/1926 | Danielson | 16/121 |
| 1,919,455 | 7/1933 | Wilson | 16/121 |
| 2,497,418 | 2/1950 | Schroeder | 401/48 |
| 3,597,097 | 8/1971 | Kellis | 401/6 |

*Primary Examiner*—Paul A. Bell

*Assistant Examiner*—John S. Brown

*Attorney, Agent, or Firm*—John L. McGannon

[57] ABSTRACT

A ball-shaped device for use in supporting an eating utensil, such as a knife, fork or spoon, or a toothbrush, so that the device operates as an eating or oral hygiene aid for persons having arthritis or other crippling diseases or injuries of the hands. The device has a first passage through it for receiving a handle of an instrument to be held, such as an eating utensil or toothbrush. A second passage transverse to and intersecting the first passage is used to threadably receive a screw which can enter the first passage and bear against the handle of the instrument. In this way, the instrument is releasably secured to the device and the instrument can then be used in a normal fashion, such as for eating or brushing the teeth. The screw has a flat head on its outer end for easy turning of the screw even with only one finger. The device is formed from a pair of substantially hemispherical members which mate to form the spherical body of the device. Each of the members has a tubular segment and a number of webs which, when the members are in mating relationship, cooperate with each other to form the first and second passages.

8 Claims, 6 Drawing Figures

EATING AND ORAL HYGIENE AID

This is a continuation-in-part of application Ser. No. 102,272, filed Dec. 10, 1979 now abandoned.

This invention relates to improvements in devices for the manual holding of instruments with handles, such as eating utensils and toothbrushes, and more particularly, to such a device for use by persons suffering from arthritis and other crippling diseases of the hands.

BACKGROUND OF THE INVENTION

Persons suffering from arthritis of the hands and fingers have great difficulty in performing the most simpliest of human tasks, such as eating food with a fork or spoon or brushing the teeth. Arthritics often cannot manipulate their fingers so that they can grasp the handles of the instrument needed to perform these tasks. The fingers can sometimes only be moved to form a partially closed fist and even then with great difficulty.

Attempts have been made in the past to provide some type of aid for holding instruments by a person suffering from diseases of the hands. For instance, U.S. Pat. No. 2,497,418 discloses a device having a rolling support for a writing instrument. In this patent, balls or rolling elements are provided on a flat bottom surface of a dome-shaped member for rolling over a surface, such as a table during a writing exercise. This structure is cumbersome to use and a disabled person using the device has difficulty in securing a writing instrument in place on the device because of the overall design.

Other references in this field include U.S. Pat. No. 1,438,114 relating to a device for permanently securing a pen to a ball to teach writing to children, and British Pat. No. 5783 relating to a pen holder which operates to prevent writers' cramp.

None of the foregoing devices are suitable for use by arthritics and others suffering from diseases or injuries of the hand. For this reason, a need has arisen for an improved eating and oral hygiene aid for use by such persons.

SUMMARY OF THE INVENTION

The present invention satisfies the aforesaid need by providing an eating and oral hygiene aid of improved construction which comprises a ball-shaped body having a first passage for receiving the handle of an instrument to be secured to the body. A second passage extends into the body and intersects the first passage. The second passage has threads to threadably mount a screw whose inner end is adapted to bear against the handle of the instrument extending into the first passage. Thus, the screw holds the instrument in place on the body.

The screw projects outwardly from the body and has a flat head which can be easily turned even with a single finger. The spherical shape of the body throughout a substantial portion thereof allows the body to be fit comfortably in the palm of the hand of arthritics and others who cannot bend the fingers sufficiently to grasp the handle of the instrument yet who can manipulate their fingers to form a ball-shaped or cup-shaped configuration of the palm.

The body of the device is preferably formed by a pair of members which are hollow to reduce the overall weight of the body. The members define a pair of hemispherical shells which mate with each other to form the ball-shaped body. Each shell has a tubular segment forming part of the first passage and a pair of webs with serrated, beveled faces forming parts of the second passage. The serrated faces define the threads for the second passage. The shells are typically adhesively bonded together but only along about one-half the outer periphery of the shells. This allows the unbonded peripheral portion of the body to be unattached so as to permit the screw to snap rearwardly in the event that the screw is tightened too tightly onto the handle of the instrument in the first passage. The shells open slightly to allow for this snap-back of the screw. This provides a safety feature for the device and prevents undue pressures exerted on the handles of the instruments in this first passage.

The primary object of the present invention is to provide an improved eating and oral hygiene device which can comfortably be fitted into the palm of the hand yet can easily be used by arthritics and others suffering diseases of the hand to thereby permit the user to be substantially self-sufficient in performing even the simpliest of human tasks, yet the device is simple and rugged in construction, is inexpensive to produce, and requires no maintenance.

Other objects of this invention will become apparent as the following specification progresses reference being had to the accompanying drawings for an illustration of the invention.

IN THE DRAWINGS

Figure 1:
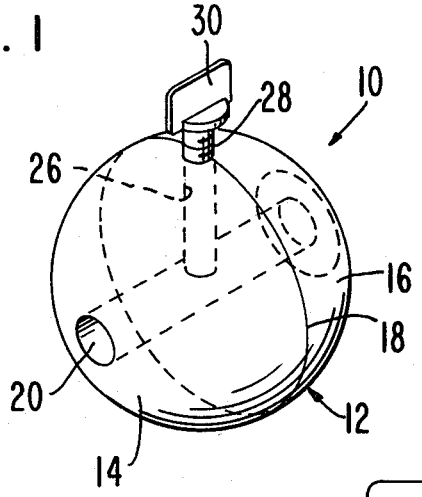
FIG. 1 is a perspective view of the eating and oral hygiene aid of the present invention, parts being shown in dashed lines to illustrate details of construction.

The eating and oral hygiene device of the present invention is broadly denoted by the numeral 10 and includes a generally ball-shaped body 12 formed of a pair of hemispherical shell members 14 and 16 which are joined together along a common line 18; thus, members 14 and 16 define halves for body 12.

Body 12 has a transversely circular passage 20 therethrough, the passage being generally perpendicular to the plane of line 18 and open at both ends. Passage 20 extends through body 12 and terminates near a flat face 22 on member 16. The purpose of face 22 is to prevent rolling of body 12 when the body is placed on a table top or other surface.

Body 12 also has an internally threaded passage 26 which extends into the body from line 18. Passage 26 is open at both ends and is adapted to threadably receive a screw 28 having a flat head 30 on the outer end thereof. Head 30 is rectangular in shape and large enough it to be moved against objects or by a single finger to cause rotation of the screw relative to body 12.

Passage 26 is perpendicular to passage 20 and communicates with the latter so that screw 28 can enter passage 20 and engage the handle 32 of an eating or oral hygiene instrument. For purposes of illustration, FIG. 2 shows a toothbrush whose handle 32 is inserted in passage 20 with the bristles 36 of the toothbrush being in a position relative to body to permit the user of the body to brush his or her teeth while holding body 12 and moving the ball back and forth.

Figure 2:
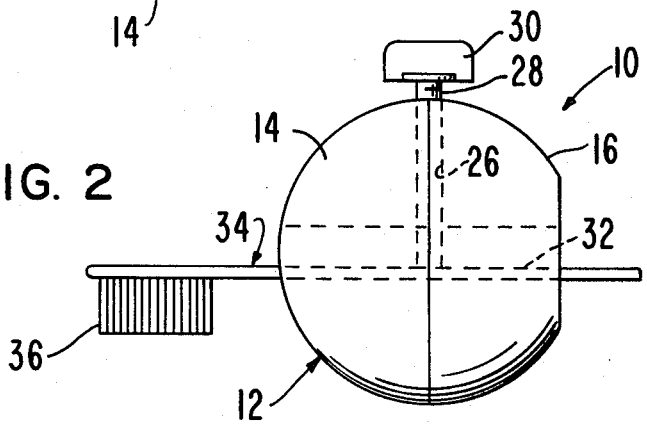
FIG. 2 is a side elevational view of the device, showing the way in which a toothbrush is removably coupled to the device.
Figure 3:
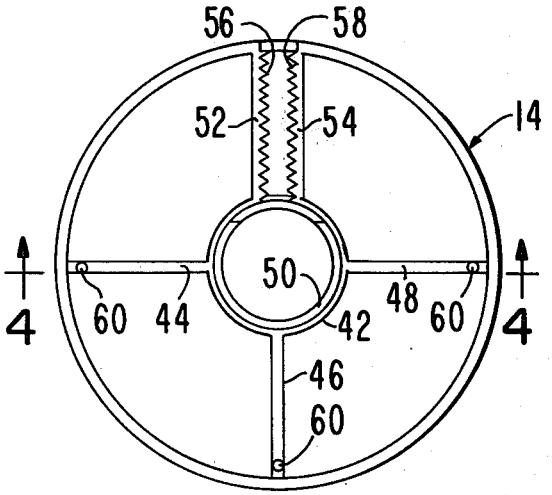
FIG. 3 is a plan view of one of the halves forming the device.
Figure 5:
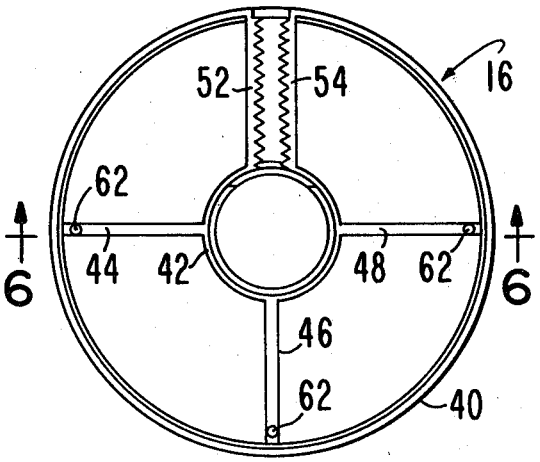
FIG. 5 is a view similar to FIG. 3 but showing the other half of the device.
Figure 4:
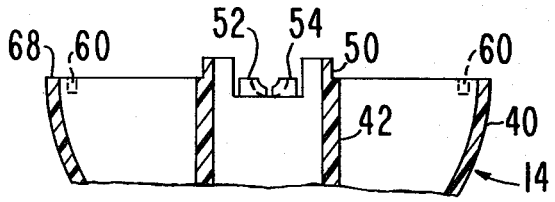
FIG. 4 is a fragementary, cross-sectional view taken along line 4—4 of FIG. 3.
Figure 6:
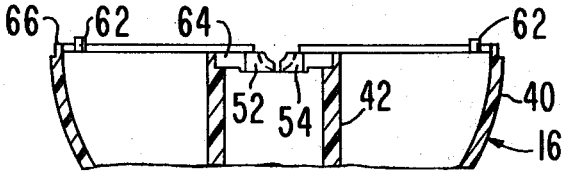
FIG. 6 is a fragmentary, cross-sectional view taken along line 6—6 of FIG. 5.

Instead of a toothbrush, an eating utensil, such as a knife, fork or spoon can be coupled with body 12 quickly and easily by inserting the handle of the utensil in passage 20 and tightening screw 28 against the handle of the utensil in the manner shown in FIG. 2.

In use, device 10 is held in the hand with the palm of the hand engaging the spherical outer surface of body 12. In this way, fingers of the hand do not need to be closed around the handle of the instrument secured to body and the instrument, such as a toothbrush or a fork, can be used in the normal fashion so long as body 12 is grasped by the hand. For persons suffering from arthritis and other crippling diseases, normal toothbrushing and eating habits can be retained yet the user need not strain body muscles because of the ease and simplicity in grasping and holding body 12. Also, the user can quickly and easily insert the handle of a toothbrush or eating utensil in passage 20 and rotate screw 28 until the handle is secured to body 12. If the user has difficulty in manually rotating the screw 28, head 30 can be moved into engagement with a fixed surface and then member 12 can be rotated relative to the fixed surface to cause rotation of screw 28 relative to member 12. In this way, screw 28 can be rotated against the handle of the instrument in passage 20 without having the user apply finger pressure to head 30 of the screw.

When the member 34 is to be removed from body 12, it is a simple matter to reverse the rotation of screw 28 to release handle 32 and allow it to be removed from passage 20. In the alternative, the user may have a number of devices 10 for use, such as for brushing the teeth, eating, writing and the like. In such cases, members 34 can remain secured to respective bodies 12 over long periods of time. This feature also permits eating utensils, when so applied to respective bodies 12 to be periodically washed because body 12 can be formed from a suitable plastic materials and can be self-washed any number of times without damage to body 12.

Members 14 and 16 are shown in their preferred forms FIGS. 3–6. Member 14 (FIGS. 3 and 4) includes a hollow plastic shell 40 having a generally cylindrical segment 42 integral therewith and reinforced by three integral webs 44, 46, and 48. A projection 50 extends outwardly from segment 42, and a pair of spaced, parallel webs 52 and 54 are integral with shell 40 and segment 42, webs 52 and 54 having beveled, serrated faces 56 and 58 which define portions of threads for threadably engaging the threads of screw 28. Webs 44, 46 and 48 have recesses 60 for a purpose to be described.

Member 16 is substantially the same as member 14 in construction except for several differences. Member 16 has a shell 40, webs 44, 46, 48, 52 and 54. However, webs 44, 46, and 48 have projections 62 which mate with and are inserted into recesses 60 of member 14 when members 14 and 16 mate to form body 12. Also, central, cylindrical segment 42 of member 16 has a circular recess 64 for receiving projection 50. An annular rib 66 is provided on the outer periphery of member 16 and engages the flat face 68 of member 14 when the members are mated.

Members 14 and 16 and screw 28 can be of any suitable construction. Preferably, they are molded from a suitable abrasion resistant plastic, such as ABS. Such material also allows the device to be dropped without breaking. It also provides a smooth outer surface for members 14 and 16 and allows screw 28 to be easily rotated in passage 28. However, members 14 and 16 and screw 28 can be formed of other materials, if desired.

Body 12 typically is of a diameter of 3" for use by adults and $2\frac{1}{4}$" for use by children. A typical diameter of passage 20 is $\frac{3}{4}$" and the diameter of screw 28 is typically $\frac{5}{8}$".

When members 14 and 16 are mated, a suitable adhesive secures projections 62 and recesses 60 so that members 14 and 16 are permanently interconnected. Also, a portion of the outer peripheral faces 66 and 68 can be adhesively bonded together. It is preferred that the portion of the peripheral faces of members 14 and 16 adjacent to the outer ends of webs 52 and 54 will be left free of adhesive. The reason for this is that this allows members 14 and 16 near the outer end of passage 26 to move slightly apart in the event that screw 28 is turned too tightly against handle 32 in passage 20. In such a case, the screw is caused to snap rearwardly instead of continuing forwardly against the handle 32 to prevent any damage to device 10. This feature is therefore a safety factor for device 10 and assures that screw can never be turned too tightly against handle 32.

What is claimed is:

1. An eating and oral hygiene device for holding an instrument having a handle comprising: a ball-shaped body formed from a pair of members and having a first passage extending therethrough, said first passage having a pair of open ends adapted to receive the handle of said instrument, said body having a second passage extending thereinto at the junction of said members from the outer periphery thereof, the second passage extending transversely of the first passage, the body having a threaded surface in the second passage; and a screw threadably mounted in the second passage for movement into the first passage against the handle of the instrument therein, whereby the screw will releasably secure the handle of the instrument to the body.

2. A device as set forth in claim 1, wherein said body has a generally flat face perpendicular to the longitudinal axis of the first passage.

3. A device as set forth in claim 1, wherein the outer end of the screw has a flat head.

4. A device as set forth in claim 1, wherein said members are hollow, generally hemispherical members, each member having first means for forming a part of the first passage and second means for forming a part of the second passage.

5. A device as set forth in claim 4, wherein the first means of each member include a generally cylindrical segment, the segments of the members being longitudinally aligned and communicating with each other when the members mate with each other to form said body.

6. A device as set forth in claim 5, wherein is included web means for securing the segment of each member with the inner surface of the member.

7. A device as set forth in claim 1, wherein the body comprises a pair of members defining halves for the body, said members being adhesively bonded together at locations remote from the outer ends of the webs to allow the members to separate in the vicinity of the outer end of the second passage and thereby release the force exerted on the screw when the screw is tightened too tightly against the handle in the first passage.

8. An eating and oral hygiene device for holding an instrument having a handle comprising: a ball-shaped body formed from a pair of hollow, generally hemispherical members, said body having a first passage extending therethrough, said first passage having a pair of open ends adapted to receive the handle of said instrument, said body having a second passage extending thereinto from the outer periphery thereof, the second passage extending transversely of the first passage, each member having first means for forming a part of the first passage and a pair of spaced, generally parallel webs for forming parts of the second passage, each of the webs having a beveled, serrated face, the webs of one member being adjacent to and aligned with respective webs of the other member to form threads in the second passage when the members are mated to form said body; and a screw threadably mounted in the second passage for movement into the first passage against the handle of the instrument therein, whereby the screw will releasably secure the handle of the instrument to the body.

* * * * *